US010317160B2

(12) United States Patent
Righi et al.

(10) Patent No.: US 10,317,160 B2
(45) Date of Patent: Jun. 11, 2019

(54) GUN COMPRISING AN ELECTRONIC DEVICE

(71) Applicant: FABBRICA D'ARMI PIETRO BERETTA S.P.A., Gardone Val Trompia, Brescia (IT)

(72) Inventors: Eugenio Righi, Brescia (IT); Valentina Chiodi, Brescia (IT); Ettore Andreis, Brescia (IT); Andrea Candian, Brescia (IT)

(73) Assignee: FABBRICA D'ARMI PIETRO BERETTA S.P.A., Gardone Val Trompia, Brescia (IT)

( * ) Notice: Subject to any disclaimer, the term of this patent is extended or adjusted under 35 U.S.C. 154(b) by 0 days.

(21) Appl. No.: 15/573,158

(22) PCT Filed: Mar. 30, 2016

(86) PCT No.: PCT/IB2016/051787
§ 371 (c)(1),
(2) Date: Nov. 10, 2017

(87) PCT Pub. No.: WO2016/181235
PCT Pub. Date: Nov. 17, 2016

(65) Prior Publication Data

US 2018/0156559 A1 Jun. 7, 2018

(30) Foreign Application Priority Data

May 14, 2015 (IT) ..... BS2015A0083

(51) Int. Cl.
*F41A 19/47* (2006.01)
*F41C 33/02* (2006.01)
(Continued)

(52) U.S. Cl.
CPC ..... *F41A 19/47* (2013.01); *F41A 35/00* (2013.01); *F41C 33/02* (2013.01); *F41C 33/029* (2013.01); *F41A 19/01* (2013.01)

(58) Field of Classification Search
CPC ..... F41A 17/06; F41A 17/063; F41A 17/066; F41A 19/01; F41A 19/47; F41A 35/00; F41C 33/02; F41C 33/029
(Continued)

(56) References Cited

U.S. PATENT DOCUMENTS 4,563,827 A 1/1986 Heltzel
5,449,103 A * 9/1995 Tilley ..... F41A 17/063 224/244
(Continued)

*Primary Examiner* — Bret Hayes
(74) *Attorney, Agent, or Firm* — Arent Fox LLP; Michael Fainberg

(57) ABSTRACT

A gun that comprises a stock with a grip having distal and proximal portions, and an electronic device suitable to detect or process situations occurring to the gun. The electronic device comprises a detector and processor designed to detect and process information relative to a status of the gun. A battery supplies power to the detector and processor and an activator suitable to activate the supplying of power to the detector and processor to match a default event including a cocking of a hammer of the gun. The activator is housed within the grip and adjacent the bottom of the grip in the proximal portion and further comprises a hammer switch element operationally connected to the hammer to detect a change of position and send an activation signal to the battery. The hammer comprises a command portion to be moved by the shooter to move the hammer.

14 Claims, 6 Drawing Sheets

(51) Int. Cl.
*F41A 35/00* (2006.01)
*F41A 19/01* (2006.01)

(58) Field of Classification Search
USPC ..... 42/70.01, 70.02, 70.04, 70.05, 70.06, 42/70.08, 70.11; 89/27.12, 28.05, 28.1, 89/28.2
See application file for complete search history.

(56) References Cited

U.S. PATENT DOCUMENTS

| | | | | |
|---|---|---|---|---|
| 5,459,957 | A * | 10/1995 | Winer | F41A 17/066 42/70.11 |
| 5,603,180 | A * | 2/1997 | Houze | F41A 17/063 42/1.01 |
| 5,953,844 | A * | 9/1999 | Harling | F41A 17/063 42/70.06 |
| 6,412,207 | B1 | 7/2002 | Crye et al. | |
| 2005/0000139 | A1 | 1/2005 | Mauch et al. | |
| 2011/0162514 | A1* | 7/2011 | Osborne | F41A 17/063 89/27.12 |
| 2017/0234636 | A1* | 8/2017 | Hafen | F41A 17/063 42/70.08 |

* cited by examiner

GUN COMPRISING AN ELECTRONIC DEVICE

CROSS-REFERENCE TO RELATED APPLICATIONS

This application is the U.S. National Stage Application of International Patent Application No. PCT/IB2016/051787, filed on Mar. 30, 2016, which claims priority to Italian Patent Application No. BS2015A000083, filed on May 14, 2015,the contents of each of which is incorporated herein by reference in its entirety.

TECHNICAL FILED

This invention relates to a gun comprising an electronic device suitable to be activated only when certain predefined events occur to the gun. Furthermore, this invention also covers a firearm kit comprising the gun and its holster. In addition, this invention also covers a holster suitable to accommodate said gun.

BACKGROUND

In the art, firearms are known comprising electronic devices of various types, for example suitable to locate the firearm, detect a shot fired, count the number of shots fired or the like.

However, all these electronic devices have the main problem of requiring large amounts of energy for their power supply both for functioning effectively and for long time periods; therefore, this problem requires the use of a power supply and recharging unit, for example a battery, of large dimensions.

It is intuitively understood that large-sized electronic devices are undesirable both the fact that they affect the geometry and behaviour of the firearm and because they are difficult to integrate into the firearm itself, especially when this is a gun.

SUMMARY

The purpose of this invention is to provide a gun comprising an electronic device suitable to detect and/or process information relating to situations or events that have occurred to the gun, effectively and for a long period of time.

This purpose is achieved by means of a gun according to claim 1. Furthermore, this purpose is achieved by means of a firearm kit according to claim 16. In addition, this purpose is also achieved by a holster suitable to accommodate said gun according to claim 17.

Further advantages and embodiments of the gun of this invention, will be apparent from the dependent claims comprising the set of annexed claims.

Furthermore, the characteristics and advantages of the gun will be apparent from the following description, given by way of non-limiting example, in accordance with the accompanying figures, in which:

DETAILED DESCRIPTION

Figure 1:
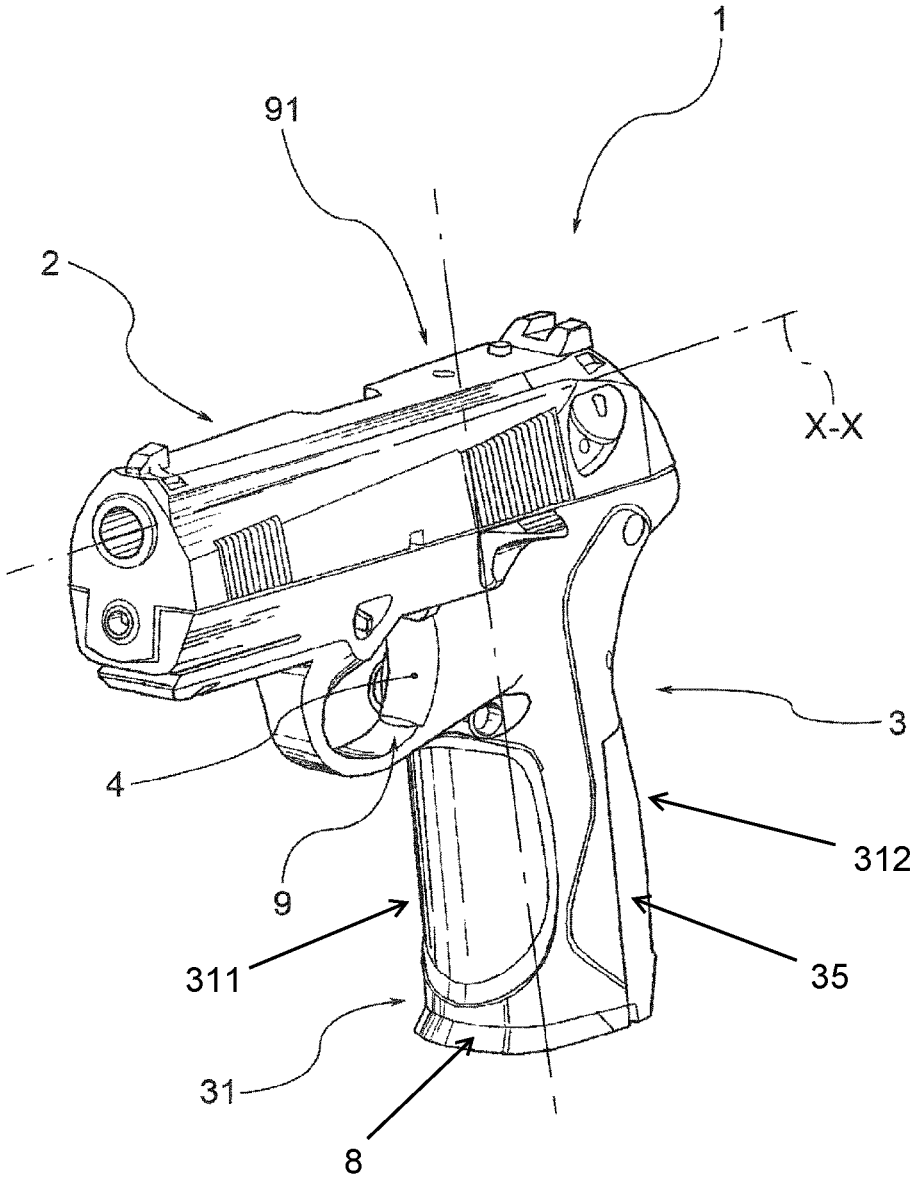
FIG. 1 is a perspective view of a firearm, in particular a gun, comprising an electronic device inside it, according to a preferred embodiment.
Figure 2A:
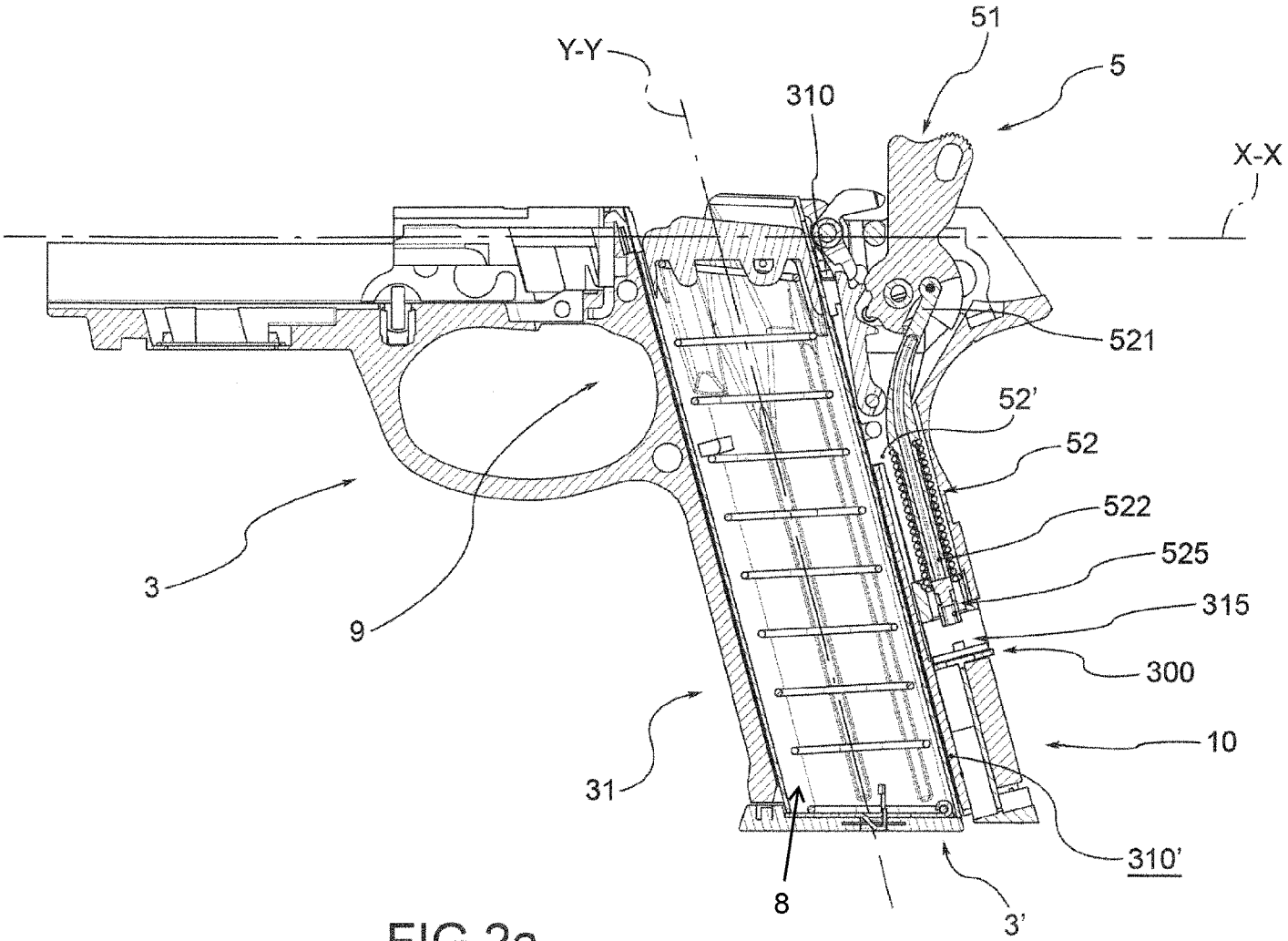
FIGS. 2*a* and 2*b* are two cross-sectional views of the stock of the gun of FIG. 1, respectively, with hammer lowered and hammer cocked.
Figure 2B:
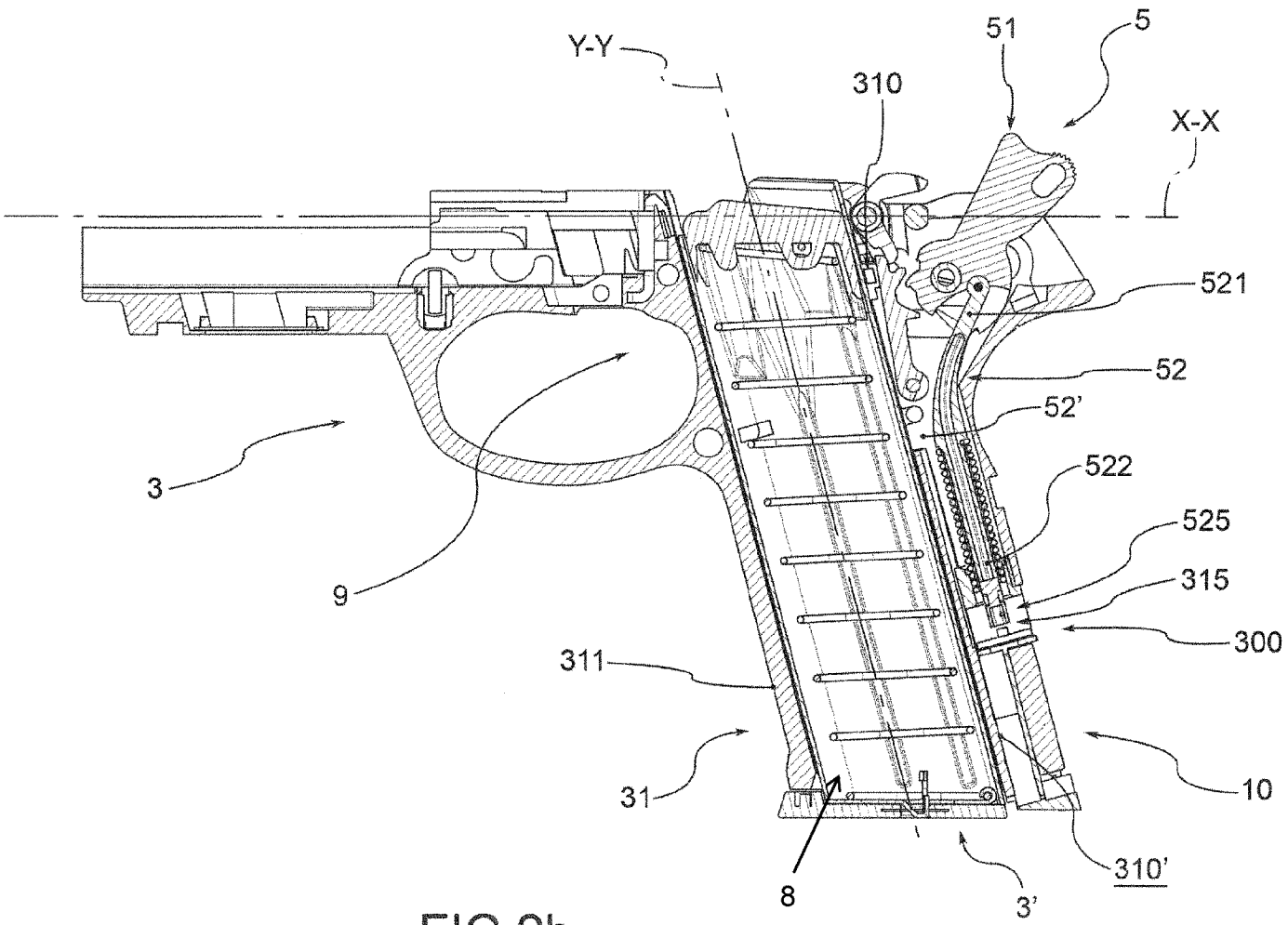
Figure 3:
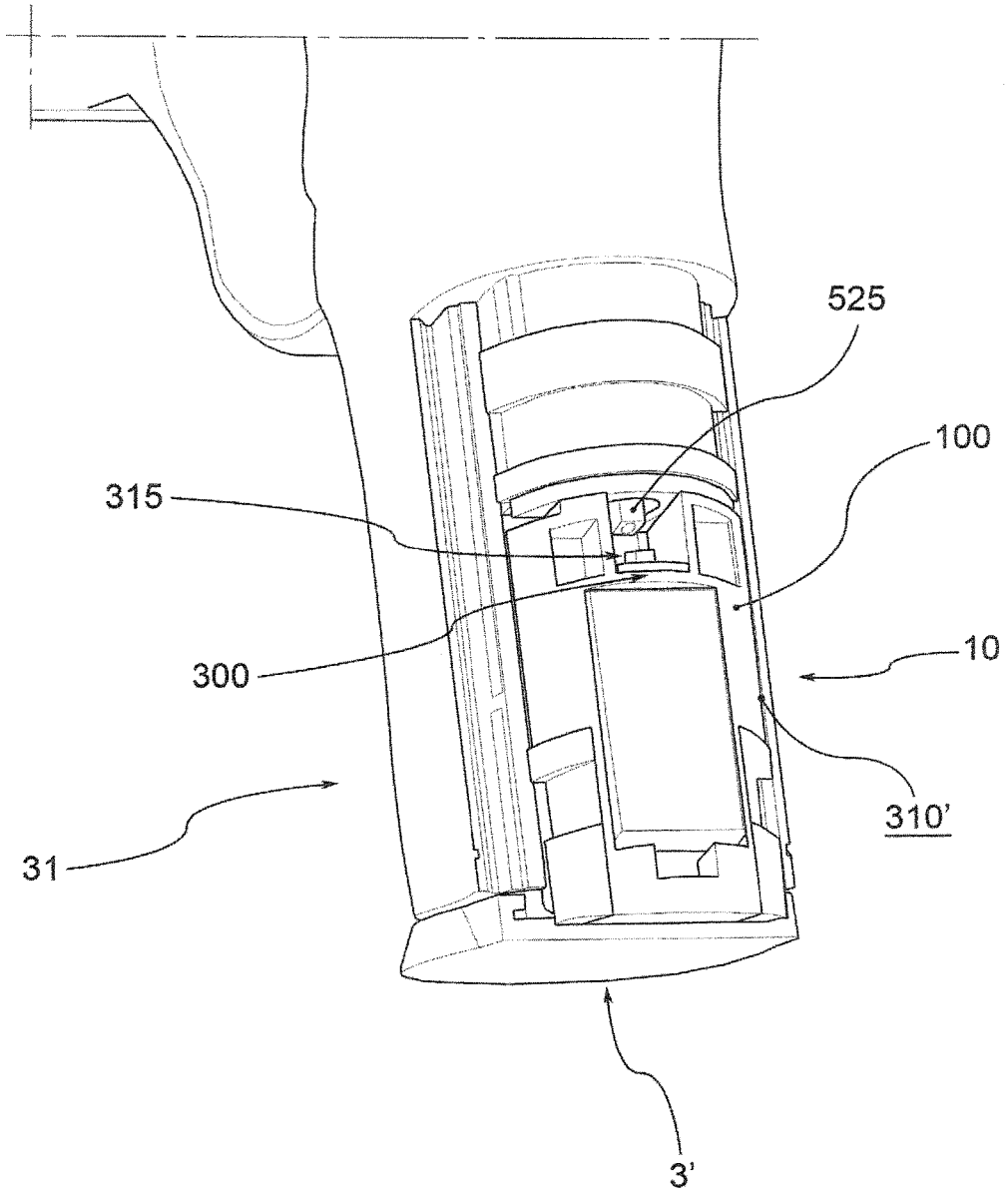
FIG. 3 shows a perspective view of the gun shown in FIG. 1 with one of its grip plates removed.
Figure 4:
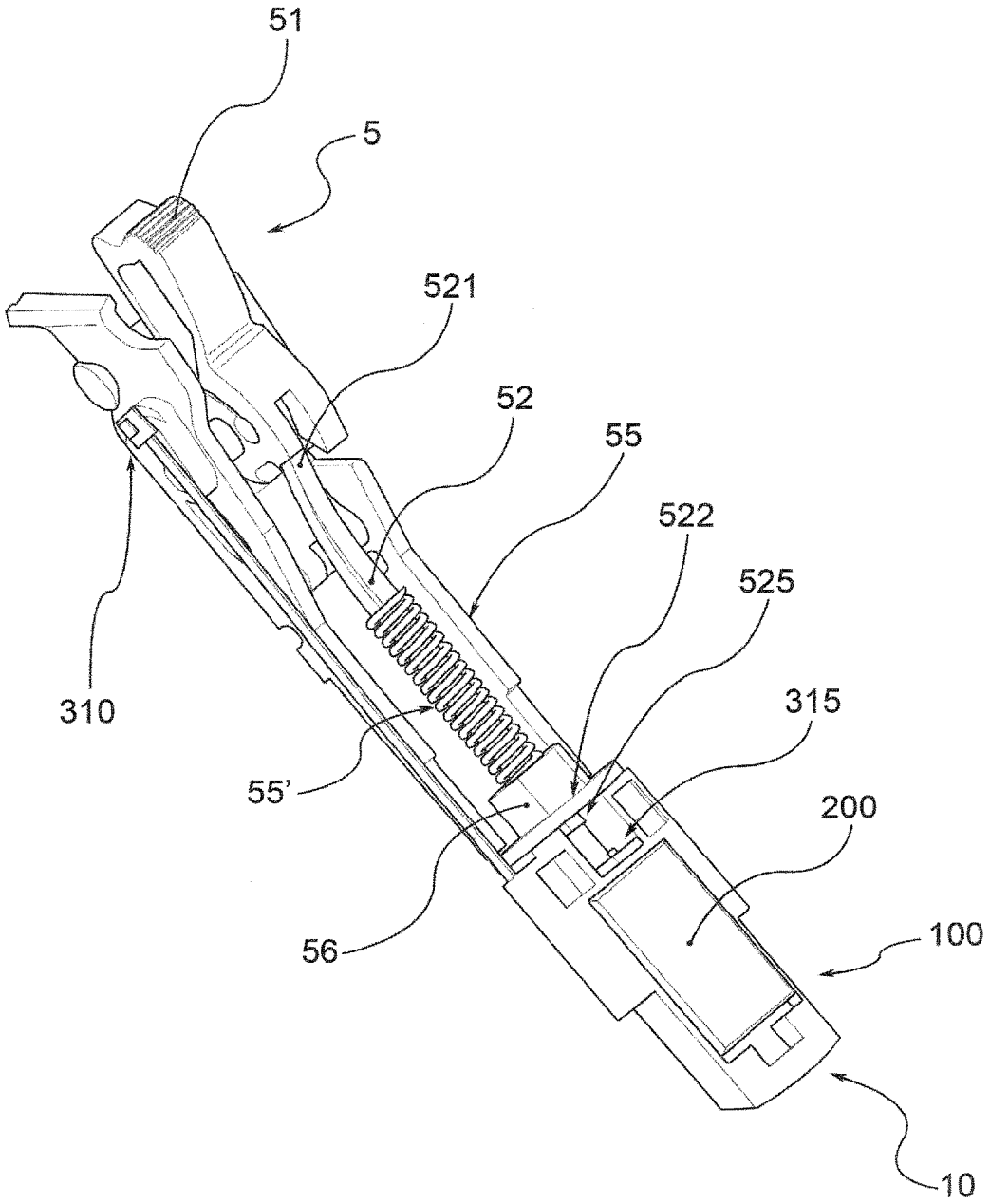
FIG. 4 shows a perspective view of the electronic device and hammer comprised in the gun according to a preferred embodiment of the invention.
Figure 5:
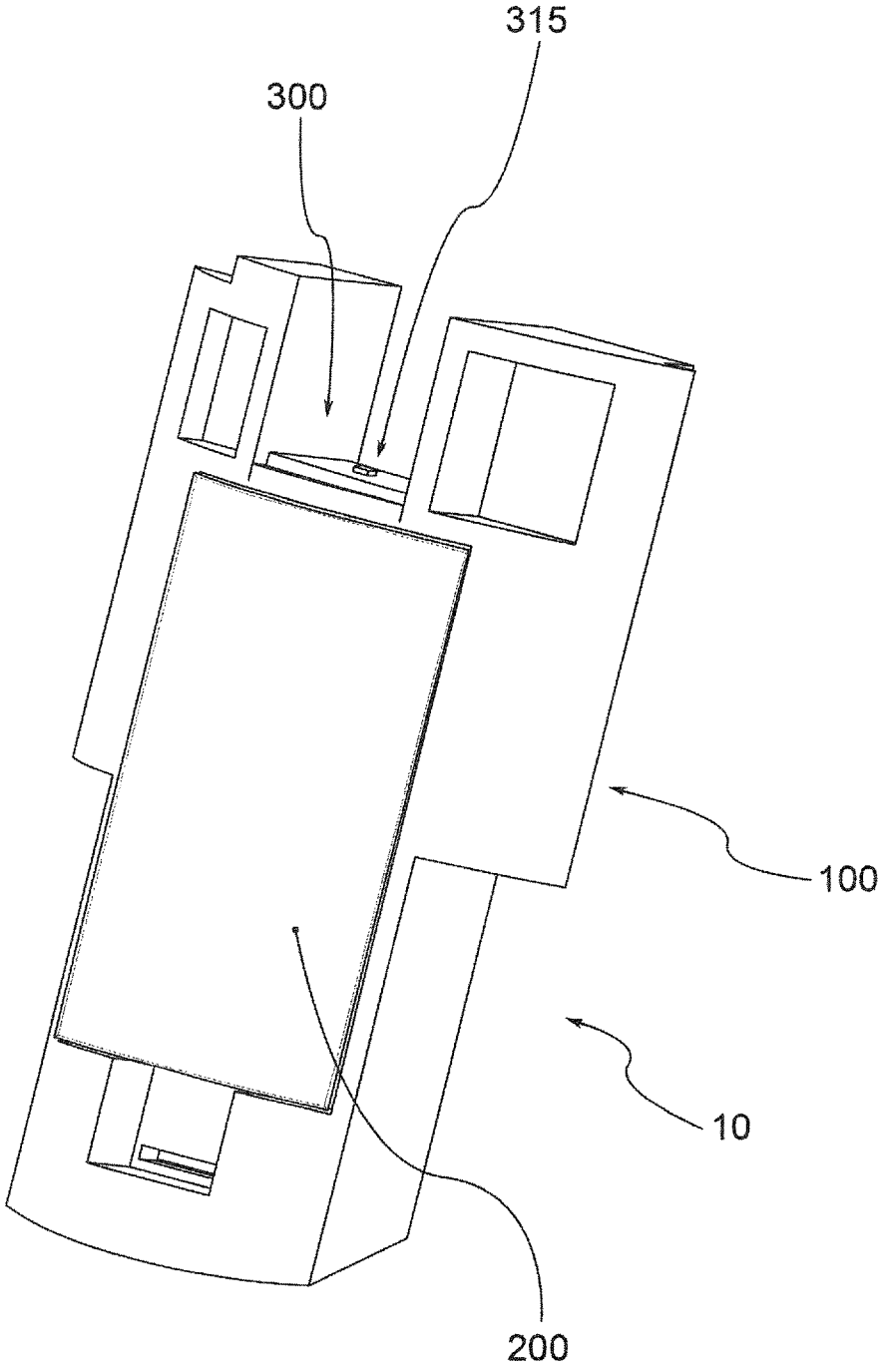
FIG. 5 is a perspective view of the electronic device comprised in the gun according to a preferred embodiment of the invention.

With reference to the accompanying figures, the reference number 1 indicates a gun in its entirety.

Preferably, the gun 1 comprises a stock 3 and a barrel 2, which extends along a firing axis X-X, comprising moving parts 91, such as a slide. Preferably, the firing axis X-X axis is the axis identifying the direction of the shot.

Furthermore, the gun 1 comprises, among other components, a firing mechanism 9, having a trigger 4 that, in the action of firing, is pressed by the shooter, and having a hammer 5 that is movable and changes position in such a way that it is suitable to strike the firing pin triggering the bullet and thus the shot, in the event of firing. In other words, the hammer 5 is suitable to be positioned, manually by the shooter or automatically by the firing mechanism 9, between a hammer cocked position and a hammer lowered position and vice versa.

Preferably, the stock 3 comprises a grip 31 having a distal portion 311 in the vicinity of the trigger 4 and a proximal portion 312 next to the palm of the shooter's hand when holding the gun. In addition, the grip 31 also identifies a bottom 3', as its final end; preferably, the magazine 8 of the gun 1 is inserted in the firearm through the bottom 3' of the grip 31. Preferably, the grip 31 extends in height along a grip axis Y-Y.

According to a preferred embodiment, the gun 1 of this invention comprises an electronic device 10 suitable to detect and/or process information relating to situations occurring to the gun.

In fact, the electronic device 10 comprises detection and processing means 100 suitable to detect and process the information. In particular, the detection and processing means 100 comprise a specific electronic and/or mechanical component (not described or shown) suitable to detect information related to the state of the gun in order to then place it at the service of the shooter and users in general.

In an embodiment, the detection and processing means 100 are suitable to detect and process an event or a change of state undergone by the firearm, for example, the information of round in barrel, weapon ready to fire, weapon pointed, or the like.

Preferably, for example, the detection and processing means 100 are suitable to assess the intensity and/or direction of the accelerations experienced by the gun 1, identifying a state, or an event, of shot fired, and possibly creating a specific "shot fired information".

In addition, the detection and processing means 100 comprise a specific component, preferably electronic (also not described or represented) for processing the information, for example the above-mentioned information of shot fired, for example for its storage and/or for its transmission.

In fact, preferably, the detection and processing means 100 comprise memory means suitable to store the information.

In addition, preferably, the detection and processing means 100 comprise transmission means suitable to send the information to a receiving device.

In fact, in a preferred embodiment, the electronic device 10 is suitable to be operatively connected with a mobile phone or smartphone, with which is respectively coupled, for example by "pairing". Preferably, the electronic device 10 is suitable to communicate with the mobile phone or smartphone with which is coupled to mutually exchange information.

In addition, in a preferred embodiment, the detection and processing means 100 comprise means of verification suitable to check and distinguish the action undergone by the gun at the moment of the firing event compared to other actions thereon, such as a falling event.

Preferably, the electronic device 100 also comprises a battery 200 for the power supply of the detection and processing means 100.

In a preferred embodiment, the battery 200 is of the type comprising lithium ions.

According to a preferred embodiment, said battery 200 is rechargeable.

Preferably, moreover, the electronic device 10 also comprises activation means 300 suitable to activate the operation of powering the detection and processing means 100 by the battery 200.

According to a preferred embodiment, said activation means 300 are suitable to perform the activation of the power supply operation of the battery 200 only in correspondence of a predefined event. In other words, as long as said event does not occur, the battery 200 does not power the detection and processing means 100, preserving the charge. In yet further other words, without the occurrence of said event the battery 200 and consequently the electronic device 10 are substantially in a dormant configuration, of "sleep", "stand by" or "suspension", in which there is minimum consumption of energy, i.e., there is a minimum circulation of electricity inside it. In a further preferred embodiment, in said dormant configuration, the electronic device 10 is substantially turned off, in other words there is no circulation of electricity inside it.

In the dormant configuration, the electronic device 10 is, thus, essentially in a power saving mode; in some embodiment variants, the electronic device 10 has minimal or no functionality, for example, the electronic device 10 maintains a "pairing" coupling with a mobile phone to which it is coupled, or again, the electronic device 10 has a timed functionality, in which, at predefined time intervals, it performs specific verification activities of its status and the status of the gun.

According to a preferred embodiment, said predefined event that involves the activation of the operations of the battery 200 through the activation means 300, is the extraction of the gun 1 from its respective holster (not shown in the accompanying figures).

According to a preferred embodiment, said predefined event that involves the activation of the operations of the battery 200 through the activation means 300, is the cocking of the hammer 5 of the gun 1, i.e., the change of position between the hammer lowered position and the hammer cocked position.

In further embodiments, said predefined event that involves the activation of the operations of the battery 200 through the activation means 300, is the cocking of the hammer 5 of the gun 1, regardless of whether or not it is removed from the respective holster (not shown in the accompanying figures).

According to some embodiments, the detection and processing means 100 activated following the aforesaid events are suitable, in the first place, to consider, detect and process as information precisely the occurrence of such events, for example by sending or storing the information.

According to a preferred embodiment, based on what is described above, operating only in he said predefined circumstances, the battery 200 is of small size, with respect to the currently known solutions and, in fact, the battery 200 is suitable to last more over time with respect to batteries of similar size and materials.

According to a preferred embodiment, the battery 200 and the activation means 300 are housed in the grip 31.

Preferably, the battery 200 and the activation means 300 are housed close to its bottom 3', in its proximal portion 312.

According to a preferred embodiment, the battery 200 and the activation means 300 are located in an area of the gun 1 farther from the moving parts 91 of the gun 1 and from its firing mechanism 9.

According to a preferred embodiment, the electronic device 10 in its entirety is housed in the grip 31, close to its bottom 3', in its proximal portion 312.

Preferably, the aforesaid elements, i.e., the battery 200 and the activation means 300, or the electronic device 10 in its entirety, are housed in a housing recess 310' specifically formed in the grip 31.

In a preferred embodiment, the grip 31 comprises at least one grip plate 35; the grip plate 35 is mountable on the gun 1 to delimit and protect the housing recess 310' and removable from the gun 1 to allow access to the housing recess 310'.

Preferably, the grip plate 35 is snap-mountable on the grip 31.

Preferably, the grip plate 35 is mountable with an action in the direction of the can be mounted with the direction of the firing axis X-X or the grip axis Y-Y.

According to a preferred embodiment, the battery 200 and the activation means 300, or the electronic device 10, in its entirety are inserted in the gun 1, in particular in the housing recess 310', substantially in the direction of the firing axis X-X.

As said, the activation means 300 of the gun 1 are suitable to operate by detecting the occurrence of a predefined event.

In particular, the activation means 300 comprise a holster switch element 310, suitable to detect the extraction of the gun from its holster so that, upon the extraction of the gun from the holster (not shown in the accompanying figures), the holster switch element 310 sends an activation signal to the battery 200.

According to a preferred embodiment, the holster switch element 310 is magnetically sensitive and detects a change of magnetic field that occurs at the time of the extraction of the pistol 1.

In a preferred embodiment, the holster switch element 310 is housed on the firearm in a position close to the trigger, for example next to the slide 91 of the gun 1.

According to a preferred embodiment, the holster houses on it a holster sensor suitable to be operatively connected to the holster switch element 310. Preferably, the holster sensor is made of a ferro-magnetic material suitable to stimulate the holster switch element 310 that, preferably, is composed of a magnetic switch with permanent magnet, and/or of a magnetically sensitive electrical circuit, for example due to the Hall effect.

In a preferred embodiment, it is of the "tactical holster" type.

According to a preferred embodiment, the activation means 300 comprise a hammer switch element 315 operationally connected to the hammer 5 in order to detect the change of position and send the activation signal to the battery 200.

Preferably, the hammer 5 comprises a command portion 51 suitable to be moved by the shooter to move the hammer 5 from the hammer lowered position to that of hammer cocked and vice versa. Preferably, moreover, the hammer 5 comprises a hammer rod 52 that extends inside the stock 3 between a command end 521 connected to the command portion 51 and a switch end 522 operatively connected to the hammer switch element 315. Preferably the hammer rod 52 is hinged with its command end 521 to the command portion 51.

Preferably, the command portion 51 is also moved by the firing mechanism of the gun itself.

In a preferred embodiment, the hammer rod 52 has an elongated shape, preferably, in a manner parallel to the grip axis Y-Y. Preferably, therefore the gun 1 has a rod housing 52'.

In a preferred embodiment, to a movement of the command portion 51 corresponds a change of position of the switch end 522 detected by the hammer switch element 315 that sends the activation signal to the battery 200.

According to a preferred embodiment, the switch end 522 comprises a magnetically sensitive element 525 operationally connected to the hammer switch element 315, in its turn magnetically sensitive. In other words, the hammer switch element 315 is suitable to detect the magnetic field variation due to the change of position of the switch end 522, and thus of the magnetically sensitive element 525.

According to a preferred embodiment, the magnetically sensitive element 525 comprises a core made of ferromagnetic material, preferably comprising an element made of a permanently magnetic material.

Preferably, said core (not shown in the accompanying figures) is also housed in a casing of a magnetically insulating, or non-magnetic, material.

In a further embodiment, the switch end 522 comprises a command element suitable to physically engage the hammer switch element 315 so that, when pressed, it sends the activation signal to the battery 200.

In a preferred embodiment, the hammer 5 further comprises an elastic element 55 suitable to perform an action on the hammer rod 52 to move the command portion 51 from the hammer cocked position to the hammer lowered position, thus resulting in the shot.

Preferably, the elastic element 55 is a helical spring 55' that extends around the hammer rod 52. Preferably, the elastic element 55 is housed in the rod housing 52'.

According to a preferred embodiment, the hammer 5 comprises a support and guidance device 56 suitable to keep the hammer rod 52 in a predefined axial position. Preferably, the support and guidance device 56 is placed inside the rod housing 52' near the switch end 522. Preferably, the support and guidance device 56 has substantially a ring shape and the switch end 522 is suitable to slide inside said ring. Preferably, a support and guidance device 56 is suitable to act as an abutment to the elastic element 55.

In addition, this invention also covers a firearm kit comprising a gun 1 according to the above description and a holster specially shaped to house said gun 1, in such a way that the gun 1 and the holster are operationally connected to each other. In particular, in the mutual operating connection, the gun 1 is suitable to detect its in-holster state its extraction from it.

Innovatively, the gun of this invention solves the typical problems of the known art, comprising an electronic device that does not require, unlike those of the prior art, large quantities of electricity to function, being suitable to be activated only upon the occurrence of a predefined event.

Advantageously, the gun comprises an electronic device that normally remains in a dormant configuration, in which it consumes a minimal or zero amount of energy, while it is activated only upon the occurrence of predefined events.

According to a further advantageous aspect, the electronic device is powered if the gun is extracted from the holster and/or if the hammer is placed in a hammer cocked position. In other words, the electronic device is turned on only when the firearm is in a ready-to-fire configuration. Advantageously, the electronic device is also suitable to detect the occurrence of both events and to process said combined information.

Advantageously, the gun is then suitable to send an alarm signal, for example to an operations centre, when the electronic device is activated. Again, advantageously, the gun is suitable to send a first alarm signal upon its extraction from the holster, and a second alarm signal upon the cocking of the hammer.

According to a still further advantageous aspect, once the detection and processing means are powered, because an event has occurred on the firearm that results in their activation, they are immediately suitable to detect a shot-fired event. In other words, advantageously, the detection and processing means are ready for the detection and assessment of an impulsive event such as a shot fired.

Advantageously, the behaviour and geometry of the gun of this invention are not influenced by the presence of the electronic device. Advantageously, the electronic device has small dimensions and is suitable to be housed in the gun. Advantageously, the insertion of the electronic device is simple and requires no special and complex operations.

Advantageously, the electronic device is suitable to function and be operatively connected with the holsters of all types, for example tactical holsters.

Advantageously, the hammer, in its movement, is suitable to provide clear information about the state of the gun and its placement in a ready-to-fire configuration.

Moreover, advantageously, the activation means are suitable to activate the electronic device in a precise and reliable manner.

In further preferred embodiments, for example in automatic guns, not having the hammer, but a specific firing mechanism comprising arming and disarming elements of the gun, the activation means are suitable to activate the power supply operations of the battery upon the occurrence of the event of arming the specific components of the gun.

It is clear that one skilled in the art, in order to meet contingent needs, may make changes to the gun described above, all contained within the scope of protection defined by the following claims.

The invention claimed is:

1. A gun comprising:

a stock with a grip having a distal portion in a vicinity of a trigger of the gun, and a proximal portion next to a palm of a hand of a shooter when the shooter is holding the gun; and an electronic device suitable to detect and/or process one or more situations occurring to the gun, the electronic device, comprising:

i) a detector and processor designed to detect and process information relative to a status of the gun;

ii) a battery for supplying power to the detector and processor, the battery being housed in the grip, wherein the battery while housed in the grip is located adjacent to a bottom of the grip and in the proximal portion; and iii) an activator suitable to activate the supplying of the power to the detector and processor, by the battery, to match a default event, wherein, said default event is a cocking of a hammer of the gun, the activator is housed in the grip, the activator while housed in the grip is located adjacent to the bottom of the grip and in the proximal portion, and the activator comprises a hammer switch element operationally connected to the hammer in order to detect a change of position and to send an activation signal to the battery, the hammer comprising:

a command portion suitable to be moved by the shooter to move the hammer, the moving of the hammer being for one of: from a hammer cocked position to a hammer lowered position, and from the hammer lowered position to the hammer cocked position; and a hammer rod that extends inside the stock between a command end connected to the command portion and a switch end operationally connected to the hammer switch element, so that a movement of the command portion corresponds to the change of position detected by the hammer switch element, the change of position being for the switch end.

2. The gun according to claim 1, wherein the electronic device, in its entirety, is housed in the grip, wherein the electronic device while housed in the grip is located adjacent to the bottom of the grip and in the proximal portion.

3. The gun according to claim 2, wherein a firing axis is identified as being the axis along which a barrel of the gun extends, and wherein the electronic device is inserted in the gun substantially in the direction of the firing axis.

4. The gun according to claim 1, wherein, the grip has a housing recess specially shaped to house the battery and the activator, or the grip has a housing recess specially shaped to house the electronic device in its entirety, and the grip further comprises at least one grip plate the grip plate when mounted on the gun, defining and protecting the housing recess, and when dismantled from the gun, allowing access to the housing recess.

5. The gun according to claim 1, wherein the switch end comprises a magnetically sensitive element operationally connected to the hammer switch element which in turn is magnetically sensitive.

6. The gun according to claim 5, wherein the magnetically sensitive element comprises a core in a ferromagnetic material.

7. The gun according to claim 6, wherein the magnetically sensitive element comprises a casing in a non-magnetic material suitable to house the core.

8. The gun according to claim 1, wherein the switch end comprises a command element suitable to physically engage the hammer switch element so that, when the hammer switch element is pressed, the hammer switch element sends the activation signal to the battery.

9. The gun according to claim 1, wherein the hammer further comprises an elastic element suitable to perform an action on the hammer rod, the action being to move the command portion from the hammer cocked position to the hammer lowered position.

10. The gun according to claim 9, wherein the hammer comprises a support and guidance device suitable to keep the hammer rod and the elastic element in a predefined axial position.

11. The gun according to claim 1, wherein the detector and processor comprises storage media suitable to store information, and/or comprise a transmitter to convey information.

12. The gun according to claim 1, wherein the detector and processor comprises a verifier suitable to check and distinguish an action performed by the gun at a moment of a firing event as compared to other actions performed by the gun at moments of other events, and wherein the detector and processor verify and process information associated with the firing event.

13. A firearm kit comprising the gun according to claim 1, and a holster shaped to house said gun.

14. A holster suitable to house the gun according to claim 1, and the holster being shaped to house said gun.

* * * * *